US008242962B2

(12) United States Patent
Chang

(10) Patent No.: US 8,242,962 B2
(45) Date of Patent: Aug. 14, 2012

(54) SUPPER-BROADBAND ANTENNA STRUCTURE

(75) Inventor: Ching Wei Chang, Pa-Te (TW)

(73) Assignee: Auden Techno Corp., Pa-Te, Tao-Yuan Hsien (TW)

( * ) Notice: Subject to any disclaimer, the term of this patent is extended or adjusted under 35 U.S.C. 154(b) by 316 days.

(21) Appl. No.: 12/782,136

(22) Filed: May 18, 2010

(65) Prior Publication Data

US 2011/0285594 A1 Nov. 24, 2011

(51) Int. Cl.
*H01Q 1/38* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS

| | | | | |
|---|---|---|---|---|
| 7,042,401 | B2 * | 5/2006 | Park et al. | 343/700 MS |
| 7,324,049 | B2 * | 1/2008 | Myoung et al. | 343/700 MS |
| 7,986,272 | B2 * | 7/2011 | Kurashima et al. | 343/700 MS |

* cited by examiner

*Primary Examiner* — Tan Ho

(74) *Attorney, Agent, or Firm* — Guice Patents PLLC

(57) ABSTRACT

A supper-broadband antenna structure designed with a specific coplanar waveguide (CPW) mode to make its covering range of frequency be in a range of about 300 MHz~9 GHz., of which the covering range of frequency is in a range of 300 MHz~9 GHz having a rational efficiency of above 40% within the range of frequency band, and the return loss is better than the value −5 dB. The structure of a single supper-broadband antenna designed according to the present invention can be applied to many usages easily and accurately, e.g., for checking chamber stability, chamber to chamber verification etc.

5 Claims, 7 Drawing Sheets

(A)

(B)

| Frequency (MHz) | 700 | 704 | 710 | 720 | 725 | 730 | 735 | 740 | 745 | 751 | 756 | 777 | 782 | 787 |
|---|---|---|---|---|---|---|---|---|---|---|---|---|---|---|
| Tot. Rad. Pwr. (dBm) | -2.35092 | -2.23393 | -2.10379 | -1.87625 | -1.695 | -1.3767 | -1.08092 | -0.84184 | -0.64644 | -0.48152 | -0.2016 | -0.18875 | -0.04506 | -0.14816 |
| Peak EIRP (dBm) | 0.272299 | 0.413193 | 0.564163 | 0.804591 | 0.965529 | 1.26248 | 1.52611 | 1.72773 | 1.91037 | 2.07491 | 2.39257 | 2.58417 | 2.71756 | 2.60992 |
| Directivity (dBi) | 2.62322 | 2.64712 | 2.66795 | 2.68084 | 2.66053 | 2.63918 | 2.60703 | 2.56957 | 2.55681 | 2.55643 | 2.59416 | 2.77292 | 2.76262 | 2.75809 |
| Efficiency (dB) | -2.35092 | -2.23393 | -2.10379 | -1.87625 | -1.695 | -1.3767 | -1.08092 | -0.84184 | -0.64644 | -0.48152 | -0.2016 | -0.18875 | -0.04506 | -0.14816 |
| Efficiency (%) | 58.198 | 59.787 | 61.6057 | 64.9195 | 67.6862 | 72.8332 | 77.9665 | 82.3789 | 86.17 | 89.5052 | 95.4642 | 95.747 | 98.9679 | 96.646 |
| Gain (dBi) | 0.272299 | 0.413193 | 0.564163 | 0.804591 | 0.965529 | 1.26248 | 1.52611 | 1.72773 | 1.91037 | 2.07491 | 2.39257 | 2.58417 | 2.71756 | 2.60992 |
| Frequency (MHz) | 824 | 836 | 849 | 869 | 880 | 894 | 900 | 915 | 925 | 940 | 960 | 1565 | 1575 | 1585 |
| Tot. Rad. Pwr. (dBm) | -0.37773 | -0.47551 | -0.7041 | -0.83048 | -0.86924 | -0.93743 | -0.96271 | -1.02704 | -1.08312 | -1.2323 | -1.33935 | -0.37314 | -0.39232 | -0.26343 |
| Peak EIRP (dBm) | 2.04897 | 1.96314 | 1.77098 | 1.67775 | 1.65885 | 1.64068 | 1.65416 | 1.70665 | 1.7476 | 1.73774 | 1.67815 | 4.1269 | 3.94723 | 3.92513 |
| Directivity (dBi) | 2.4267 | 2.43864 | 2.47508 | 2.50823 | 2.52808 | 2.57811 | 2.61687 | 2.7337 | 2.83072 | 2.97005 | 3.0175 | 4.50004 | 4.33955 | 4.18856 |
| Efficiency (dB) | -0.37773 | -0.47551 | -0.7041 | -0.83048 | -0.86924 | -0.93743 | -0.96271 | -1.02704 | -1.08312 | -1.2323 | -1.33935 | -0.37314 | -0.39232 | -0.26343 |
| Efficiency (%) | 91.67 | 89.6292 | 85.0335 | 82.5947 | 81.8609 | 80.5855 | 80.1179 | 78.9398 | 77.9271 | 75.2956 | 73.4623 | 91.7669 | 91.3624 | 94.1147 |
| Gain (dBi) | 2.04897 | 1.96314 | 1.77098 | 1.67775 | 1.65885 | 1.64068 | 1.65416 | 1.70665 | 1.7476 | 1.73774 | 1.67815 | 4.1269 | 3.94723 | 3.92513 |
| Frequency (MHz) | 1710 | 1750 | 1785 | 1805 | 1840 | 1850 | 1880 | 1910 | 1920 | 1930 | 1950 | 1960 | 1980 | 1990 |
| Tot. Rad. Pwr. (dBm) | -0.30448 | -0.34693 | -0.32014 | -0.12717 | -0.17292 | -0.29528 | -0.71505 | -1.31488 | -1.45795 | -1.54853 | -1.47184 | -1.31575 | -1.30059 | -0.95819 |
| Peak EIRP (dBm) | 2.92598 | 2.69614 | 2.54684 | 2.96799 | 3.24681 | 3.22768 | 2.99972 | 2.58032 | 2.41841 | 2.3851 | 2.44465 | 2.66441 | 2.64076 | 2.95442 |
| Directivity (dBi) | 3.23046 | 3.04307 | 2.86698 | 3.09516 | 3.41973 | 3.52296 | 3.71476 | 3.8952 | 3.87636 | 3.93363 | 3.91648 | 3.98016 | 3.94135 | 3.91261 |
| Efficiency (dB) | -0.30448 | -0.34693 | -0.32014 | -0.12717 | -0.17292 | -0.29528 | -0.71505 | -1.31488 | -1.45795 | -1.54853 | -1.47184 | -1.31575 | -1.30059 | -0.95819 |
| Efficiency (%) | 93.2293 | 92.3223 | 92.8936 | 97.1144 | 96.0966 | 93.4268 | 84.8194 | 73.8774 | 71.4834 | 70.0078 | 71.2552 | 73.8627 | 74.121 | 80.2013 |
| Gain (dBi) | 2.92598 | 2.69614 | 2.54684 | 2.96799 | 3.24681 | 3.22768 | 2.99972 | 2.58032 | 2.41841 | 2.3851 | 2.44465 | 2.66441 | 2.64076 | 2.95442 |
| Frequency (MHz) | 2110 | 2140 | 2170 | 2400 | 2450 | 2500 | 2550 | 2600 | 2650 | 2700 | 2750 | 2800 | 2850 | 2900 |
| Tot. Rad. Pwr. (dBm) | -1.78884 | -1.70441 | -1.60454 | -2.29339 | -1.38361 | -0.9221 | -0.86234 | -0.97449 | -1.10002 | -1.28361 | -1.51599 | -1.37872 | -1.55323 | -2.40284 |
| Peak EIRP (dBm) | 1.99969 | 2.0489 | 2.39161 | 0.601086 | 2.28821 | 3.86265 | 4.01211 | 3.92705 | 3.83047 | 3.71037 | 3.50909 | 3.64453 | 3.12756 | 2.01516 |
| Directivity (dBi) | 3.78853 | 3.75331 | 3.99616 | 2.89448 | 3.67182 | 4.78475 | 4.87445 | 4.90154 | 4.93048 | 4.99398 | 5.02508 | 5.02325 | 4.68079 | 4.418 |
| Efficiency (dB) | -1.78884 | -1.70441 | -1.60454 | -2.29339 | -1.38361 | -0.9221 | -0.86234 | -0.97449 | -1.10002 | -1.28361 | -1.51599 | -1.37872 | -1.55323 | -2.40284 |
| Efficiency (%) | 66.2393 | 67.5396 | 69.1108 | 58.974 | 72.7176 | 80.8704 | 81.9909 | 79.9008 | 77.6244 | 74.4112 | 70.5344 | 72.7994 | 69.9322 | 57.5064 |
| Gain (dBi) | 1.99969 | 2.0489 | 2.39161 | 0.601086 | 2.28821 | 3.86265 | 4.01211 | 3.92705 | 3.83047 | 3.71037 | 3.50909 | 3.64453 | 3.12756 | 2.01516 |

FIG. 6A

| Frequency (MHz) | 2950 | 3000 | 3050 | 3100 | 3150 | 3200 | 3250 | 3300 | 3350 | 3400 | 3450 | 3500 | 3550 | 3600 |
|---|---|---|---|---|---|---|---|---|---|---|---|---|---|---|
| Tot. Rad. Pwr. (dBm) | -2.47826 | -1.8305 | -2.04182 | -2.0849 | -1.38473 | -1.20617 | -1.03734 | -0.84642 | -1.14782 | -0.98878 | -0.75711 | -1.19566 | -1.20731 | -0.70365 |
| Peak EIRP (dBm) | 2.38364 | 2.67619 | 2.42064 | 2.40495 | 2.53707 | 2.75343 | 3.11437 | 3.54652 | 3.34563 | 3.52636 | 4.03194 | 3.69977 | 3.85855 | 4.60462 |
| Directivity (dBi) | 4.8619 | 4.5076 | 4.46246 | 4.48985 | 3.9218 | 3.9596 | 4.15171 | 4.39295 | 4.49345 | 4.51513 | 4.78905 | 4.89543 | 5.06587 | 5.30827 |
| Efficiency (dB) | -2.47826 | -1.8305 | -2.04182 | -2.0849 | -1.38473 | -1.20617 | -1.03734 | -0.84642 | -1.14782 | -0.98878 | -0.75711 | -1.19566 | -1.20731 | -0.70365 |
| Efficiency (%) | 56.5164 | 65.6069 | 62.491 | 61.8742 | 72.6988 | 75.75 | 78.7529 | 82.292 | 76.7747 | 79.6383 | 84.002 | 75.9336 | 75.7302 | 85.0423 |
| Gain (dBi) | 2.38364 | 2.67619 | 2.42064 | 2.40495 | 2.53707 | 2.75343 | 3.11437 | 3.54652 | 3.34563 | 3.52636 | 4.03194 | 3.69977 | 3.85855 | 4.60462 |
| Frequency (MHz) | 3650 | 3700 | 3750 | 3800 | 3850 | 3900 | 3950 | 4000 | 4050 | 4100 | 4150 | 4200 | 4250 | 4300 |
| Tot. Rad. Pwr. (dBm) | -1.14691 | -1.61456 | -1.27346 | -1.04191 | -1.26851 | -1.20522 | -1.81818 | -2.09511 | -2.57119 | -2.89935 | -1.94112 | -1.15139 | -0.83013 | -1.07167 |
| Peak EIRP (dBm) | 4.488 | 3.92707 | 4.23328 | 4.4485 | 4.09472 | 3.7608 | 3.55066 | 4.19188 | 3.7019 | 2.05772 | 3.14369 | 3.60554 | 3.73189 | 3.75925 |
| Directivity (dBi) | 5.63491 | 5.54163 | 5.50674 | 5.49041 | 5.36323 | 4.96602 | 5.36884 | 6.28699 | 6.27309 | 4.95727 | 5.08481 | 4.75693 | 4.56202 | 4.83092 |
| Efficiency (dB) | -1.14691 | -1.61456 | -1.27346 | -1.04191 | -1.26851 | -1.20522 | -1.81818 | -2.09511 | -2.57119 | -2.89935 | -1.94112 | -1.15139 | -0.83013 | -1.07167 |
| Efficiency (%) | 76.7908 | 68.9515 | 74.5855 | 78.67 | 74.6704 | 75.7667 | 65.7934 | 61.729 | 55.3199 | 51.2915 | 63.957 | 76.7115 | 82.6013 | 78.1328 |
| Gain (dBi) | 4.488 | 3.92707 | 4.23328 | 4.4485 | 4.09472 | 3.7608 | 3.55066 | 4.19188 | 3.7019 | 2.05772 | 3.14369 | 3.60554 | 3.73189 | 3.75925 |
| Frequency (MHz) | 4350 | 4400 | 4450 | 4500 | 4550 | 4600 | 4650 | 4700 | 4750 | 4800 | 4850 | 4900 | 4950 | 5000 |
| Tot. Rad. Pwr. (dBm) | -1.39346 | -1.36264 | -1.48818 | -1.73358 | -1.54894 | -1.23133 | -1.44427 | -1.51978 | -1.4828 | -2.1396 | -2.83057 | -2.84973 | -2.44781 | -3.61195 |
| Peak EIRP (dBm) | 3.40066 | 3.62904 | 3.15315 | 2.96158 | 3.57142 | 4.19302 | 4.19137 | 4.40297 | 4.25296 | 3.58342 | 3.41335 | 2.7749 | 2.71733 | 1.87567 |
| Directivity (dBi) | 4.79412 | 4.99168 | 4.64133 | 4.69517 | 5.12037 | 5.42435 | 5.63564 | 5.92276 | 5.73575 | 5.72302 | 6.24392 | 5.62463 | 5.16514 | 5.48762 |
| Efficiency (dB) | -1.39346 | -1.36264 | -1.48818 | -1.73358 | -1.54894 | -1.23133 | -1.44427 | -1.51978 | -1.4828 | -2.1396 | -2.83057 | -2.84973 | -2.44781 | -3.61195 |
| Efficiency (%) | 72.5529 | 73.0695 | 70.9875 | 67.0875 | 70.0012 | 75.3125 | 71.7089 | 70.4728 | 71.0755 | 61.0998 | 52.1126 | 51.8833 | 56.9139 | 43.5316 |
| Gain (dBi) | 3.40066 | 3.62904 | 3.15315 | 2.96158 | 3.57142 | 4.19302 | 4.19137 | 4.40297 | 4.25296 | 3.58342 | 3.41335 | 2.7749 | 2.71733 | 1.87567 |
| Frequency (MHz) | 5050 | 5100 | 5150 | 5200 | 5250 | 5300 | 5350 | 5400 | 5450 | 5470 | 5500 | 5550 | 5600 | 5650 |
| Tot. Rad. Pwr. (dBm) | -4.21412 | -3.47774 | -3.2775 | -2.75692 | -2.2701 | -2.72817 | -2.92405 | -2.28499 | -1.74642 | -1.73674 | -1.89025 | -1.99057 | -1.9449 | -1.85075 |
| Peak EIRP (dBm) | 1.52767 | 1.93564 | 1.79542 | 2.2441 | 2.42477 | 1.93109 | 1.83647 | 1.8909 | 2.71965 | 2.85363 | 2.68001 | 2.47253 | 2.49289 | 2.8841 |
| Directivity (dBi) | 5.74179 | 5.41338 | 5.07291 | 5.00102 | 4.69487 | 4.65926 | 4.76052 | 4.17589 | 4.46607 | 4.59037 | 4.57026 | 4.4631 | 4.43779 | 4.73485 |
| Efficiency (dB) | -4.21412 | -3.47774 | -3.2775 | -2.75692 | -2.2701 | -2.72817 | -2.92405 | -2.28499 | -1.74642 | -1.73674 | -1.89025 | -1.99057 | -1.9449 | -1.85075 |
| Efficiency (%) | 37.8955 | 44.8979 | 47.0165 | 53.0039 | 59.2912 | 53.356 | 51.003 | 59.0882 | 66.8896 | 67.0388 | 64.7106 | 63.2329 | 63.9014 | 65.3018 |
| Gain (dBi) | 1.52767 | 1.93564 | 1.79542 | 2.24414 | 2.42477 | 1.93109 | 1.83647 | 1.8909 | 2.71965 | 2.85363 | 2.68001 | 2.47253 | 2.49289 | 2.8841 |

FIG. 6B

| Frequency (MHz) | 5700 | 5725 | 5750 | 5800 | 5850 | 5900 | 5950 | 6000 | 6050 | 6100 | 6150 | 6200 | 6250 | 6300 |
|---|---|---|---|---|---|---|---|---|---|---|---|---|---|---|
| Tot. Rad. Pwr. (dBm) | -2.22204 | -2.40358 | -2.28366 | -2.18504 | -2.89163 | -3.60972 | -3.07933 | -3.8603 | -5.49383 | -4.88838 | -4.23702 | -3.67419 | -2.75245 | -2.77771 |
| Peak EIRP (dBm) | 2.82138 | 2.93175 | 3.38258 | 3.81747 | 3.22347 | 2.40102 | 3.20774 | 2.58722 | 1.07222 | 2.0395 | 2.01672 | 1.4108 | 1.9691 | 1.92509 |
| Directivity (dBi) | 5.04341 | 5.33533 | 5.66624 | 6.00251 | 6.11509 | 6.01074 | 6.28707 | 6.44752 | 6.56604 | 6.92788 | 6.25374 | 5.08499 | 4.72155 | 4.7028 |
| Efficiency (dB) | -2.22204 | -2.40358 | -2.28366 | -2.18504 | -2.89163 | -3.60972 | -3.07933 | -3.8603 | -5.49383 | -4.88838 | -4.23702 | -3.67419 | -2.75245 | -2.77771 |
| Efficiency (%) | 59.951 | 57.4966 | 59.1063 | 60.4639 | 51.3851 | 43.554 | 49.2115 | 41.1121 | 28.2239 | 32.4461 | 37.6962 | 42.9122 | 53.0585 | 52.7508 |
| Gain (dBi) | 2.82138 | 2.93175 | 3.38258 | 3.81747 | 3.22347 | 2.40102 | 3.20774 | 2.58722 | 1.07222 | 2.0395 | 2.01672 | 1.4108 | 1.9691 | 1.92509 |
| Frequency (MHz) | 6350 | 6400 | 6450 | 6500 | 6550 | 6600 | 6650 | 6700 | 6750 | 6800 | 6850 | 6900 | 6950 | 7000 |
| Tot. Rad. Pwr. (dBm) | -2.43941 | -2.38797 | -2.65166 | -2.7399 | -3.0648 | -2.62511 | -2.56577 | -3.13734 | -2.72723 | -2.27364 | -2.22739 | -2.08669 | -2.05022 | -2.18984 |
| Peak EIRP (dBm) | 2.75681 | 2.59935 | 2.4895 | 2.8749 | 2.35821 | 2.82181 | 3.11267 | 2.22177 | 2.52612 | 2.73975 | 3.63267 | 4.32779 | 4.09389 | 3.3257 |
| Directivity (dBi) | 5.19622 | 4.98731 | 5.14117 | 5.6348 | 5.42301 | 5.44692 | 5.67845 | 5.3591 | 5.25335 | 5.03339 | 5.86006 | 6.41448 | 6.14411 | 5.51554 |
| Efficiency (dB) | -2.43941 | -2.38797 | -2.65166 | -2.7399 | -3.0648 | -2.62511 | -2.56577 | -3.13734 | -2.72723 | -2.27364 | -2.22739 | -2.08669 | -2.05022 | -2.18984 |
| Efficiency (%) | 57.0241 | 57.7037 | 54.3042 | 52.9676 | 49.3765 | 54.6372 | 55.3889 | 48.5586 | 53.3675 | 59.2429 | 59.8771 | 61.8488 | 62.3704 | 60.397 |
| Gain (dBi) | 2.75681 | 2.59935 | 2.4895 | 2.8749 | 2.35821 | 2.82181 | 3.11267 | 2.22177 | 2.52612 | 2.73975 | 3.63267 | 4.32779 | 4.09389 | 3.3257 |
| Frequency (MHz) | 7050 | 7100 | 7150 | 7200 | 7250 | 7300 | 7350 | 7400 | 7450 | 7500 | 7550 | 7600 | 7650 | 7700 |
| Tot. Rad. Pwr. (dBm) | -2.01521 | -2.10792 | -2.16268 | -2.16137 | -2.18548 | -2.42309 | -2.5275 | -2.43997 | -2.66787 | -2.5871 | -2.38704 | -2.33597 | -2.7505 | -3.14378 |
| Peak EIRP (dBm) | 3.36526 | 2.76261 | 3.00299 | 3.22867 | 3.08839 | 2.08748 | 2.13827 | 2.94266 | 2.07344 | 2.38279 | 2.92227 | 2.52215 | 3.28765 | 1.9226 |
| Directivity (dBi) | 5.38047 | 4.87053 | 5.16568 | 5.39004 | 5.27387 | 4.51057 | 4.66577 | 5.38263 | 4.74131 | 4.96989 | 5.30931 | 4.85812 | 6.03815 | 5.06638 |
| Efficiency (dB) | -2.01521 | -2.10792 | -2.16268 | -2.16137 | -2.18548 | -2.42309 | -2.5275 | -2.43997 | -2.66787 | -2.5871 | -2.38704 | -2.33597 | -2.7505 | -3.14378 |
| Efficiency (%) | 62.8751 | 61.5471 | 60.7759 | 60.7944 | 60.4578 | 57.2389 | 55.8792 | 57.0168 | 54.1019 | 55.1176 | 57.716 | 58.3987 | 53.0823 | 48.4867 |
| Gain (dBi) | 3.36526 | 2.76261 | 3.00299 | 3.22867 | 3.08839 | 2.08748 | 2.13827 | 2.94266 | 2.07344 | 2.38279 | 2.92227 | 2.52215 | 3.28765 | 1.9226 |
| Frequency (MHz) | 7750 | 7800 | 7850 | 7900 | 7950 | 8000 | 8050 | 8100 | 8150 | 8200 | | | | |
| Tot. Rad. Pwr. (dBm) | -3.10289 | -3.02738 | -2.92197 | -3.01482 | -3.6633 | -4.24742 | -3.91417 | -3.20918 | -2.74348 | -2.4485 | | | | |
| Peak EIRP (dBm) | 2.72456 | 1.96075 | 1.85374 | 2.06339 | 2.79309 | 0.349852 | 1.97947 | 1.95036 | 2.33701 | 2.5477 | | | | |
| Directivity (dBi) | 5.82745 | 4.98813 | 4.77571 | 5.0782 | 6.45639 | 4.59727 | 5.89365 | 5.15954 | 5.0805 | 4.99621 | | | | |
| Efficiency (dB) | -3.10289 | -3.02738 | -2.92197 | -3.01482 | -3.6633 | -4.24742 | -3.91417 | -3.20918 | -2.74348 | -2.4485 | | | | |
| Efficiency (%) | 48.9453 | 49.8037 | 51.0274 | 49.948 | 43.0199 | 37.6061 | 40.6053 | 47.7619 | 53.1682 | 56.9049 | | | | |
| Gain (dBi) | 2.72456 | 1.96075 | 1.85374 | 2.06339 | 2.79309 | 0.349852 | 1.97947 | 1.95036 | 2.33701 | 2.5477 | | | | |

FIG. 6C

SUPPER-BROADBAND ANTENNA STRUCTURE

BACKGROUND OF THE INVENTION

1. Field of the Invention

The present invention relates to a supper-broadband antenna structure, and especially to an antenna structure endued with specific shape design to make its covering range of frequency be in a range of about 300 MHz~9 GHz.

2. Description of the Prior Art

A mobile phone must get through a test of chamber stability. The chamber stability test proceeds with many kinds of dipolar antennas when frequencies are less than 3 GHz; FIG. 1 (A) shows such a dipolar antenna; as to those with bands of higher frequencies, the test proceeds with many kinds of horn shaped antennas in pursuance of the bands chosen, FIG. 1 (B) shows some horn shaped antennas. The cost of production of each of these antennas is quite expensive.

Therefore, the conventional chamber stability tests must pay a lot of moneys to buy antennas of different frequency bands for completing the tests. This evidently shows that the conventional technique is not economic and improvement is needed.

SUMMARY OF THE INVENTION

Therefore the present invention provides a supper-broadband antenna structure of which the covering range of frequency is in a range of about 300 MHz~9 GHz having a rational efficiency of above 40% within the range of frequency band. Practically, it is more important to set the chamber covering range of frequency in a range of 600 MHz~9 GHz. The structure of a single supper-broadband antenna designed according to the present invention can be applied to many usages easily and accurately, e.g., for checking chamber stability, chamber to chamber verification etc.

Although the antenna irradiation mode of the supper-broadband antenna structure of the present invention is not completely omni-directional, it still can provide fine effect in covering the desired width of frequency band, and can be used for the purpose of substitutional calibration or checking chamber stability. The main advantage of the present invention is being simple for manufacturing and economic by cost. In comparison with the requirement of multiple antennas asked conventionally, the present invention needs only an antenna structure, so that the easiness of use of the present invention is an importance advantage too.

The supper-broadband antenna structure of the present invention comprises:

a microwave base plate in a rectangular shape;

an irradiation unit formed by printing above the surface of the microwave base plate, and extending downwards from the upper edge of the microwave base plate to form two contracted stepped portions which together form below them a conical portion which is provided thereon with two protruding coupling portions;

a coplanar waveguide unit formed by printing beneath the microwave base plate, and being provided with a central microstrip formed by a vertical portion and a horizontal portion, the top end of the vertical portion being connected to the top of the conical portion of the irradiation unit and extending downwards to connect the left end of the horizontal portion, the right end of the horizontal portion extending to the right edge of the microwave base plate; a first ground in an "L" shaped plane being provided below and on the left side of the central microstrip, its upper edge tilting downwards and rightwards, the tilting upper edge forming thereon a protruding coupling portion; and a second ground in a "trapezoid" shaped plane being provided above and on the right side of the central microstrip; and a radio frequency connector provided on the right side of the microwave base plate to connect the right end of the central microstrip for signal feeding in, and to connect the first and the second grounds.

The present invention will be apparent in its structural feature and effect in using after reading the detailed description of the preferred embodiment thereof in reference to the accompanying drawings.

BRIEF DESCRIPTION OF THE DRAWINGS

FIGS. 6A-6C are charts showing the antenna characteristics of the present invention.

DETAILED DESCRIPTION OF THE PREFERRED EMBODIMENT

Figure 2:
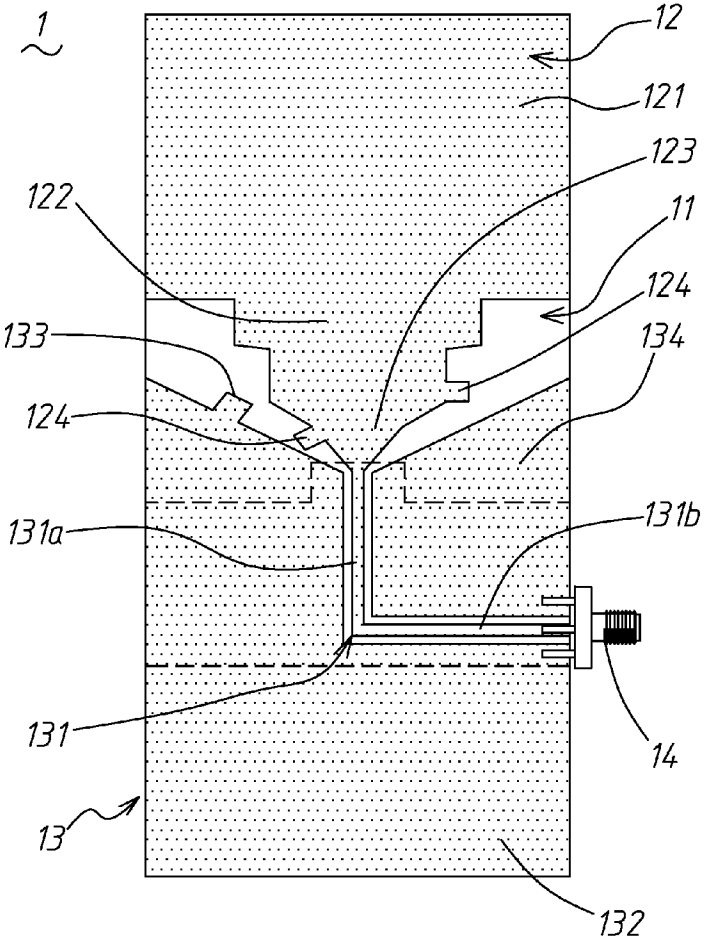
FIG. 2 is a front side view of the present invention.

Referring to FIG. 2, a supper-broadband antenna structure 1 provided in the present invention mainly comprises: a microwave base plate 11, an irradiation unit 12, a coplanar waveguide (CPW) unit 13 and a radio frequency connector 14.

The microwave base plate 11 is in a rectangular shape, it is made of FR4 with a size of 100 mm long, 60 mm wide and 1.8 mm thick.

The irradiation unit 12 is formed by printing above the surface of the microwave base plate 11, and extends downwards from the upper edge of the microwave base plate 11 to form a rectangular portion 121 and then to form two contracted stepped portions 122 which together form below them a conical portion 123, the conical portion 123 is provided on the lateral sides thereof with two protruding coupling portions 124.

The coplanar waveguide (CPW) unit 1 is formed by printing beneath the microwave base plate 11, and is provided with a central microstrip 131 formed by a vertical portion 131*a* and a horizontal portion 131*b*, the top end of the vertical portion 131*a* is connected to the top of the conical portion 123 of the irradiation unit 12 and extends downwards to connect the left end of the horizontal portion 131*b*, the right end of the horizontal portion 131*b* extends to the right edge of the microwave base plate 11; a first ground 132 which is in an "L" shaped plane is provided below and on the left side of the central microstrip 131, its upper edge tilts downwards and rightwards, the tilting upper edge forms thereon a protruding coupling portion 133; and a second ground 134 which is in a "trapezoid" shaped plane is provided above and on the right side of the central microstrip 131.

The radio frequency connector 14 provided on the right side of the microwave base plate 11 to connect the right end of the horizontal portion 131*b* of the central microstrip 131 for signal feeding in, and to connect the first and the second grounds 132, 134.

In the present invention, the coupling portions 124 and 133 are used as coupling elements to make the antenna be provided with larger band width, and make better matching under higher frequencies. The present invention includes a structure similar to a monopole antenna (such as the structure with the irradiation unit 12 and the central microstrip 131), it further is provided with the first and the second grounds 132, 134 that encircle a feed in point to induce a transmission line effect.

Figure 4:
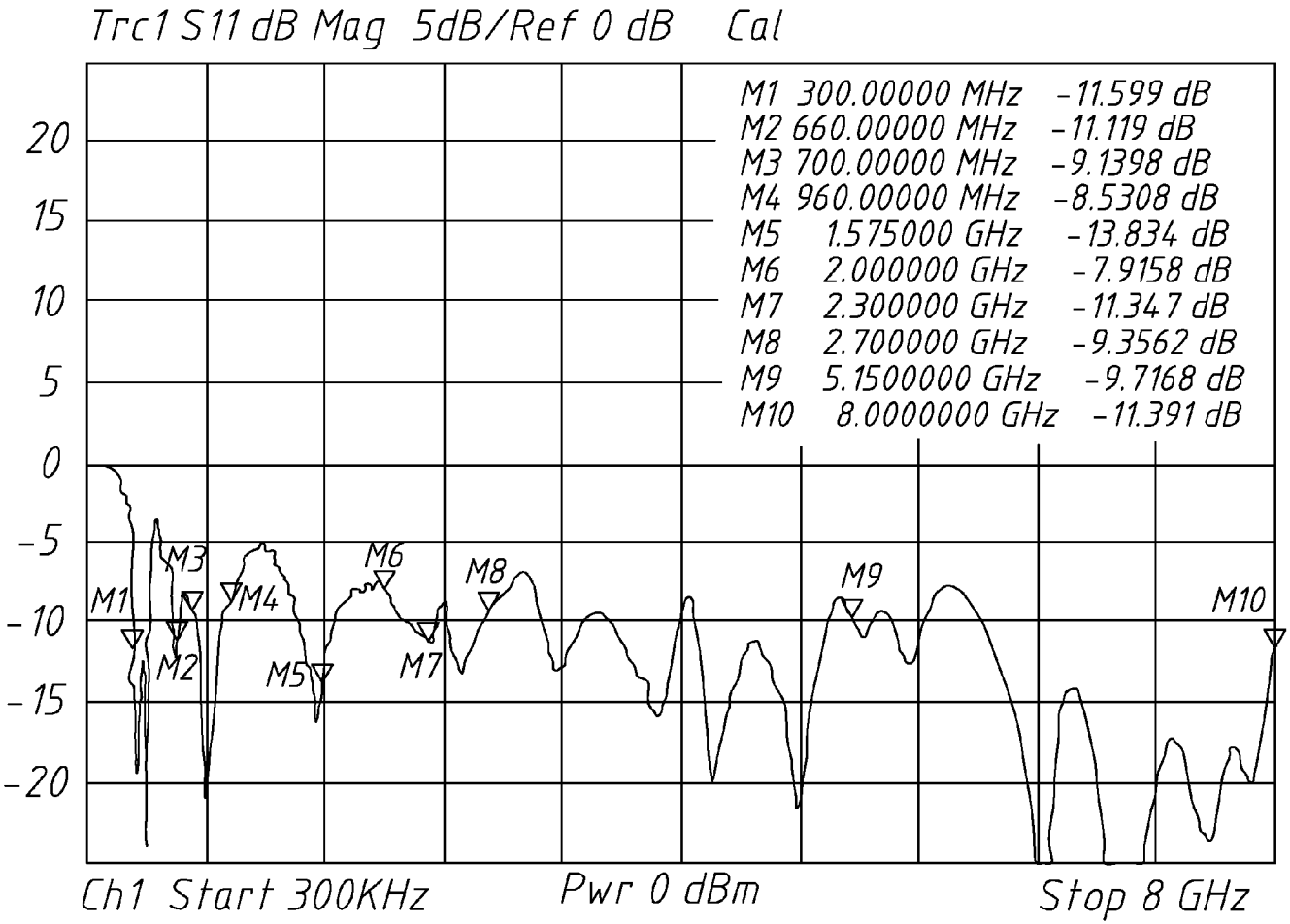
FIG. 4 is a chart showing a return loss test result of the present invention.
Figure 5:
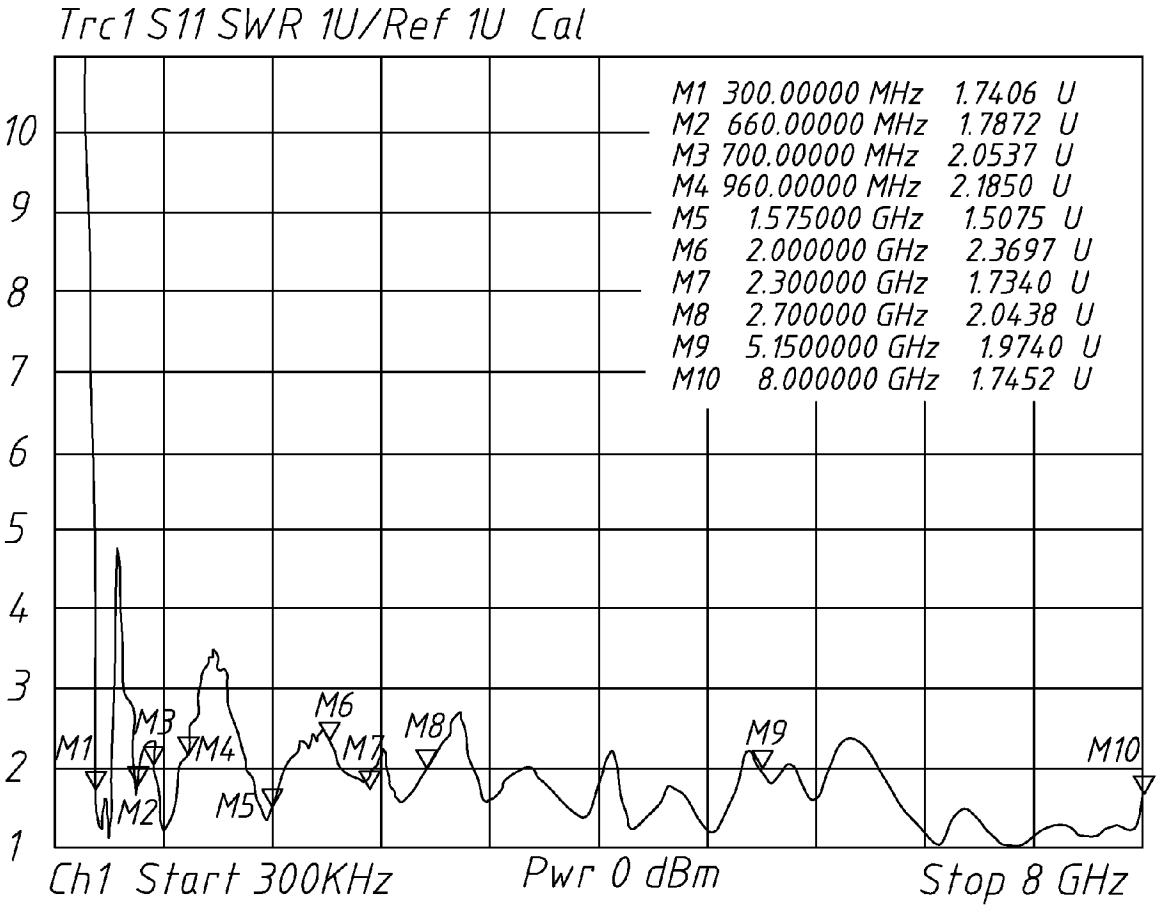
FIG. 5 is a chart showing a test result of standing wave voltage ratio (VSWR) of the present invention.

Referring to FIGS. 4 and 5 showing a return loss test result and a test result of standing wave voltage ratio (VSWR) of the present invention; the supper-broadband antenna structure 1 provided in the present invention has a covering range of frequency in a range of 300 MHz~9 GHz having a rational efficiency of above 40% within the range of frequency band. The return loss is better than the value −5 dB.

FIGS. 6A-6C are charts showing the antenna characteristics of the present invention.

Figure 1:
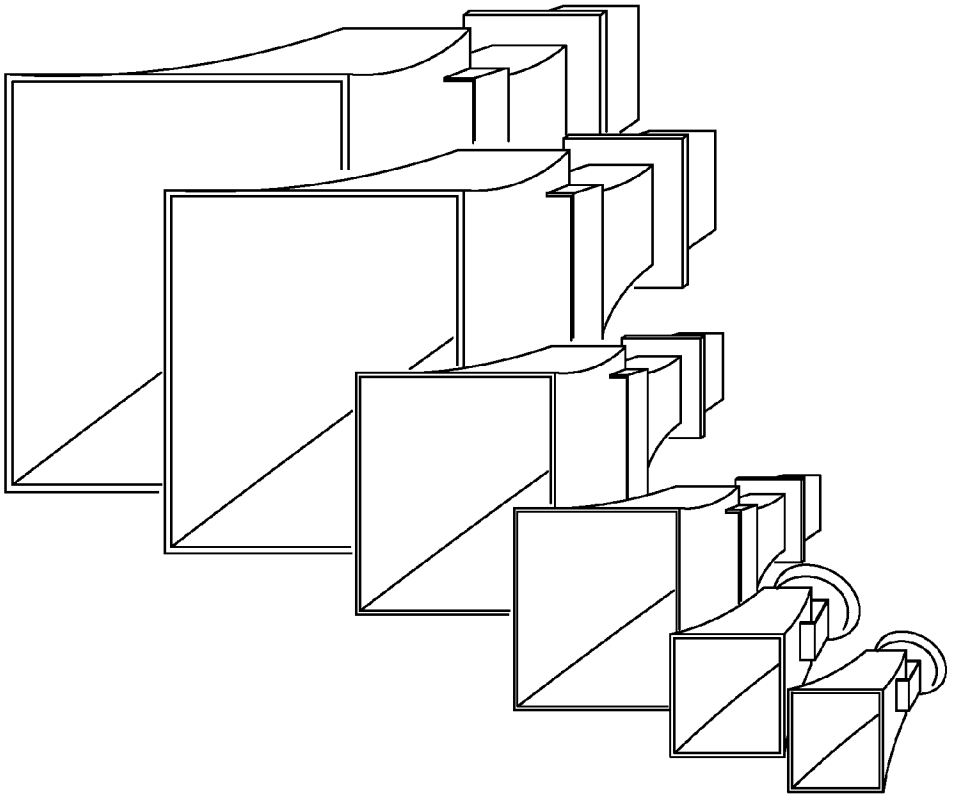
FIG.1 Prior Art
FIG. 1 is a perspective view showing conventional chamber verification antennas, in which FIG. 1 (A) shows such a cylindrical antenna; while FIG. 1 (B) shows some horn shaped antennas.
Figure 3:
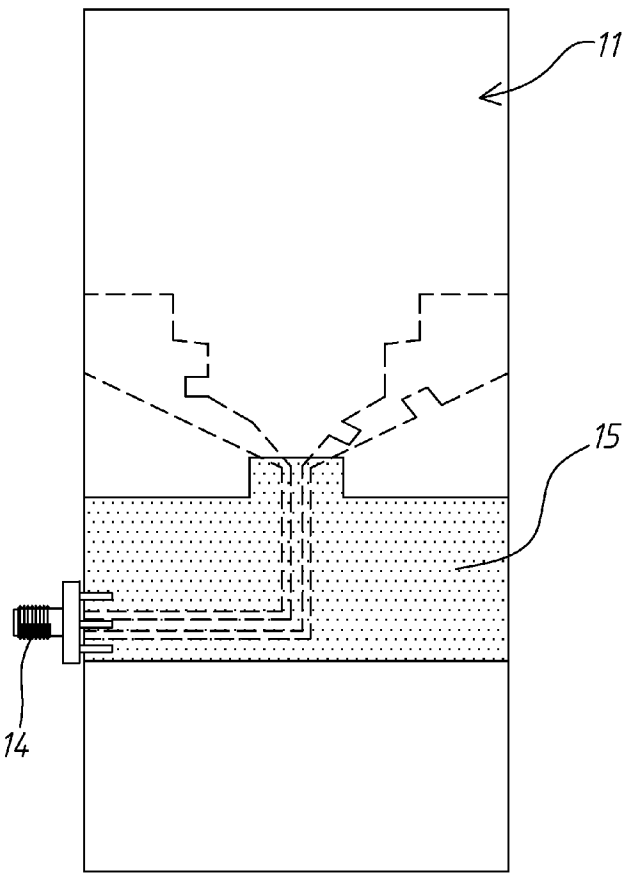
FIG. 3 is a back side view of the present invention.

Further referring to FIG. 3, in the supper-broadband antenna structure 1 of the present invention, the microwave base plate 11 is provided on its back side with a metallic sheet 15 provided at an area where the central microstrip 131 meets the first and the second grounds 132, 134. The metallic sheet 15 provides a transmission line effect, to follow the trail of the signal fed in the antenna on the surface of the microwave base plate 11. The purpose of adding the metallic sheet 15 is to increase the band width, and to get better impedance matching even only with a normal band width.

In conclusion, having now particularly described and ascertained the novelty and improvement of the supper-broadband antenna structure of my invention and in what manner the same is to be performed, what we claim will be declared in the claims followed.

The invention claimed is:

1. A supper-broadband antenna structure comprising:

a microwave base plate in a rectangular shape;

an irradiation unit formed by printing above a surface of said microwave base plate, and extending downwards from an upper edge of said microwave base plate to form a rectangular portion and then to form two contracted stepped portions which together form below them a conical portion, said conical portion being provided thereon with two protruding coupling portions;

a coplanar waveguide unit formed by printing beneath said microwave base plate, and provided with a central microstrip formed by a vertical portion and a horizontal portion, a top end of said vertical portion being connected to a top of said conical portion of said irradiation unit and extending downwards to connect a left end of said horizontal portion, a right end of said horizontal portion extending to a right edge of said microwave base plate; a first ground in an "L" shaped plane being provided below and on a left side of said central microstrip, its upper edge tilting downwards and rightwards, said tilting upper edge forming thereon a protruding coupling portion; and a second ground in a "shaped plane" shape being provided above and on a right side of said central microstrip; and a radio frequency connector provided on a right side of said microwave base plate to connect said right end of said central microstrip for signal feeding in, and to connect said first and said second grounds.

2. The supper-broadband antenna structure as defined in claim 1, wherein said microwave base plate is provided on its back side with a metallic sheet provided at an area where said central microstrip meets said first and said second grounds.

3. The supper-broadband antenna structure as defined in claim 1, wherein said microwave base plate is made of FR4.

4. The supper-broadband antenna structure as defined in claim 1, wherein said microwave base plate is in a size of 100 mm long, 60 mm wide and 1.8 mm thick.

5. The supper-broadband antenna structure as defined in claim 1, wherein covering range of frequency of said antenna structure is in a range of 300 MHz~9 GHz.

* * * * *